US005097786A

United States Patent [19]

Sheffield

[11] Patent Number: 5,097,786

[45] Date of Patent: Mar. 24, 1992

[54] METHOD AND APPARATUS FOR ERECTING AND REMOVING OFFSHORE STRUCTURES

[76] Inventor: Woodrow W. Sheffield, 2422 Kennings Rd., Crosby, Tex. 77532

[21] Appl. No.: 249,786

[22] Filed: Sep. 27, 1988

[51] Int. Cl.[5] ..... B63B 35/44

[52] U.S. Cl. ..... 114/258; 114/27; 405/209

[58] Field of Search ..... 114/265, 264, 125, 258-260, 114/44, 45, 28-32; 405/196, 201-209; 414/471, 475, 476, 477, 137.7, 137.8, 138.1, 138.5, 140.6; 108/145

[56] References Cited

U.S. PATENT DOCUMENTS

| | | | |
|---|---|---|---|
| 3,036,438 | 5/1962 | Sims | 214/164.5 |
| 3,054,267 | 9/1962 | Alcorn et al. | 114/32 |
| 3,450,282 | 3/1967 | Ezolt | 114/258 |
| 3,472,035 | 10/1969 | Broussard et al. | 405/221 |
| 3,507,126 | 4/1970 | Rochelle | 405/221 |
| 3,633,369 | 1/1972 | Lawrence | 61/46.5 |
| 3,895,552 | 7/1975 | King | 114/45 |
| 3,906,879 | 9/1975 | Lucht | 114/258 |
| 4,041,711 | 8/1977 | Lucas | 61/91 |
| 4,683,832 | 8/1987 | Dysarz | 114/258 |
| 4,690,586 | 9/1987 | Oksuzler | 405/203 |
| 4,829,924 | 5/1989 | Dysarz | 114/264 |

*Primary Examiner*—Ed Swinehart
*Attorney, Agent, or Firm*—Paul S. Madan

[57] ABSTRACT

A method and apparatus for erecting and removing offshore structures including a jacket and a platform is disclosed. The system of the invention includes a platform-lifting unit, a jacket lifting unit, and a control unit. The platform-lifting unit includes a laterally and vertically movable truss member, which is hingedly connected to a barge with lifting beams, and a means for positioning the truss member at desired height and at lateral displacement above the barge. The jacket-lifting unit contains a ballast tank structure connected to a strong back that has a plurality of grappling members. The control unit contains all supporting and controlling systems for the other units. To remove the platform, the truss member of the platform lifting unit is moved underneath the platform, the truss is raised to exert force on the platform, the platform is severed from the jacket, and the platform is moved on top of the barge. To remove the jacket, the jacket-lifting unit is lowered by controllably flooding the ballast sections at varying rates, the grappling members are securely attached to the jacket structure, the jacket-lifting unit is pulled by the control unit to tilt the jacket, and the ballast sections are deballasted to controllably lift and float the jacket.

11 Claims, 8 Drawing Sheets

METHOD AND APPARATUS FOR ERECTING AND REMOVING OFFSHORE STRUCTURES

BACKGROUND OF THE INVENTION

1. Field of the Invention

The present invention relates to a method and apparatus for erecting and removing offshore structures. The present invention is deemed particularly useful for use in deep and/or rough ocean.

2. Description of Prior Art

Derrick barges or crane ships have been extensively used for erecting and removing offshore structures. However, their lifting capacity is limited by their weight lifting capacity, water depth, environmental conditions, etc. Increasing the capacity of a derrick barge requires building larger, more powerful and versatile derrick barges, which can become prohibitively expensive. Even then, a larger barge would not provide the flexibility needed for removing and erecting different types of offshore structures currently in use for oil and gas exploration around the globe.

Recently, semi-submersible systems, utilizing floating tanks, have been designed that are towed to an offshore construction site for use in erecting or removing offshore structures. U.S. Pat. No. 4,683,832 is an example of such a structure. These systems, however, have many disadvantages: they afford little or no system flexibility; they address only the removal of part of an offshore structure; they are limited in their application by water depth; and they are unstable for use in deep and/or rough seas.

The present invention has solved major disadvantages of apparatus currently in use by providing a flexible system that is less expensive, very stable over a broad range of operating conditions, and extremely safe to operate especially in rough and/or deep sea operations.

SUMMARY OF THE INVENTION

The system of the invention contains three main items: a control unit or a mother barge, a deck-lifting unit or a deck-lifting barge, and a jacket removal structure or a semi-submersible barge. The system is used to erect and remove an offshore structure, which has a jacket resting or embedded into the ocean floor and a deck supported on top of the jacket above the ocean waterline.

The deck-lifting unit includes a truss member hingedly supported by spaced apart parallel lifting beams on a strong back mounted on the surface of a barge in the fore and aft direction. The deck-lifting unit also includes means to laterally move the truss and position it at varying heights above the barge.

The jacket-lifting unit includes at least one semi-submersible vessel that has ballastable sections, a structural strong back member securely attached to the top surface of the semi-submersible vessel, and grappling members adjustedly attached to the strong back on the opposite side from the ballast structure.

To remove the platform or deck of the offshore structure, the deck-lifting unit is positioned near the offshore structure by the control unit. The barge of the deck-lifting unit is ballasted to lower the deck-lifting unit while positioning the truss underneath the deck. The barge is deballasted until the truss exerts a slight pressure underneath the deck. The deck is severed from the jacket. The truss is then laterally moved until the deck rests on the barge. The deck-lifting unit with the deck is then towed onshore by suitable means.

To remove the jacket, the semi-submersible barge is positioned near the jacket. The ballast tanks are flooded independently and at varying rates to controllably lower the semi-submersible barge to a near vertical position. The grappling members are then securely connected to the jacket. The semi-submersible barge is pulled by the control unit about its base, thereby tilting the jacket. The ballast tanks are then independently deballasted at varying rates to controllably lift and float the jacket atop the semi-submersible barge. The semi-submersible barge is then towed onshore to dismount the jacket from the semi-submersible barge.

To erect an offshore structure, the steps described above are done in the reverse order.

Examples of the more important features of the invention have thus been summarized rather broadly in order that the detailed description thereof that follows may be better understood, and in order that the contribution to the art may be better appreciated. There are, of course, additional features of the invention that will be described hereinafter and which will also form the subject of the claims appended hereto.

BRIEF DESCRIPTION OF THE DRAWINGS

For detailed understanding of the present invention references should be made to the following detailed description of the preferred embodiment, taken in conjunction with the accompanying drawings, in which like parts are given, like reference numerals and wherein.

DETAILED DESCRIPTION OF THE PREFERRED EMBODIMENT

Figure 1:
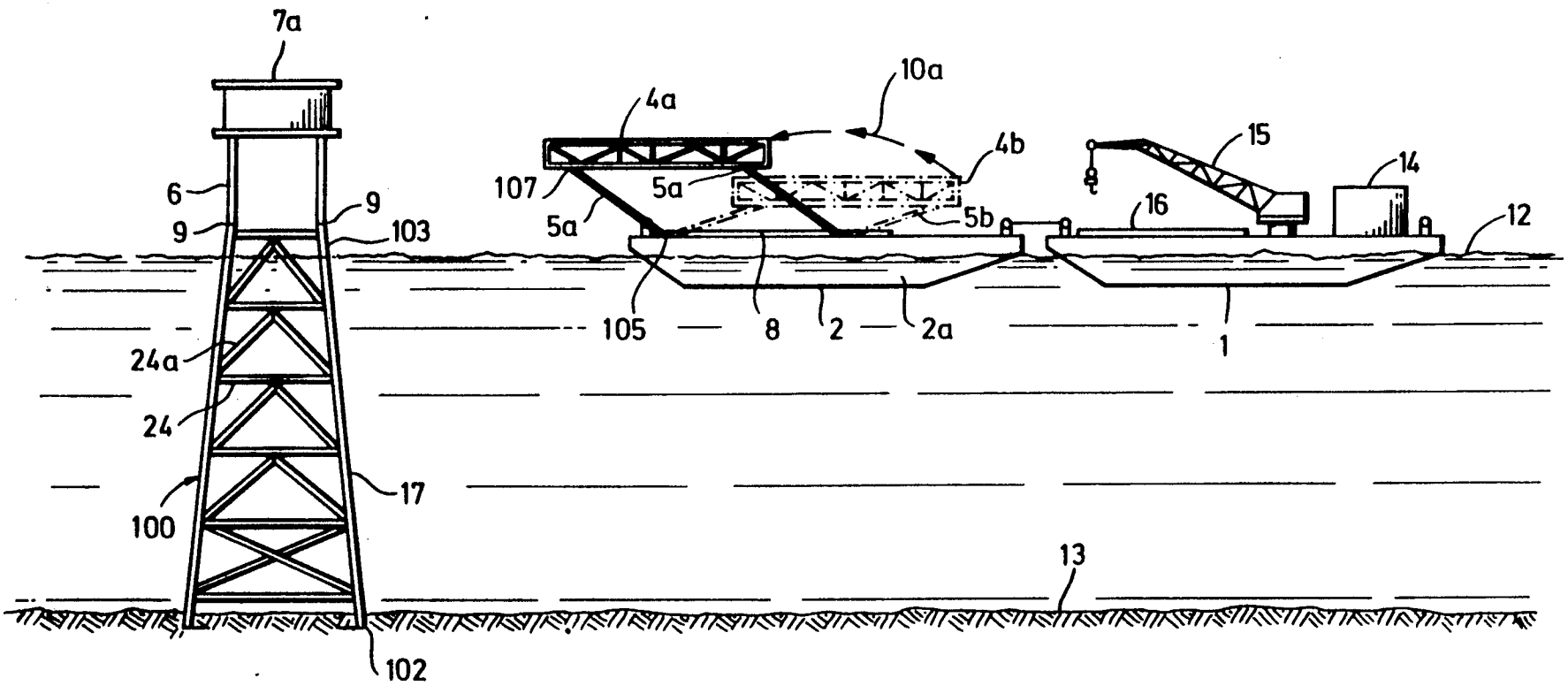
FIG. 1 depicts a deck-lifting unit being moved near an offshore structure by the control unit.

In order to more fully understand the system of the invention, it is considered helpful to first describe a typical offshore structure used for oil and gas exploration and production. Structures used for such operations are generally supported by the sea floor or bed. A typical structure is shown in FIG. 1. It includes a platform or deck 7*a* that is connected to a jacket structure 100 by platform legs 6 at splice points 9. The deck 7*a* houses the necessary drilling and/or production equipment used in the exploration and production of oil and gas offshore. The jacket structure includes a plurality of legs 17, which can be several feet in diameter, a plurality of cross bars 24 and 24*a* interconnecting the legs. The lower end 102 of the jacket structure 100 either rests on or is embedded in the sea floor, while the upper end 103 that is connected to the platform legs 6 is above the sea level. Frequently pilings (item 25 in FIG. 4) are driven several feet deep through jacket legs 17 into the sea bed to provide lateral support to the jacket structure, thereby, providing greater stability to the entire offshore structure.

The details of the preferred embodiment described herein are described respecting removal of offshore structures. However, it should be noted that the system of the invention is equally applicable when it is desired to erect or install offshore structures. The system of the invention can also be readily used for installing or removing offshore structures other than those used for the exploration and production of oil and gas. As an example, this system may be used to remove a large object from lying on the sea floor. Additionally, the system of the invention is not limited to any particular water depth or geographical area.

Figure 2:
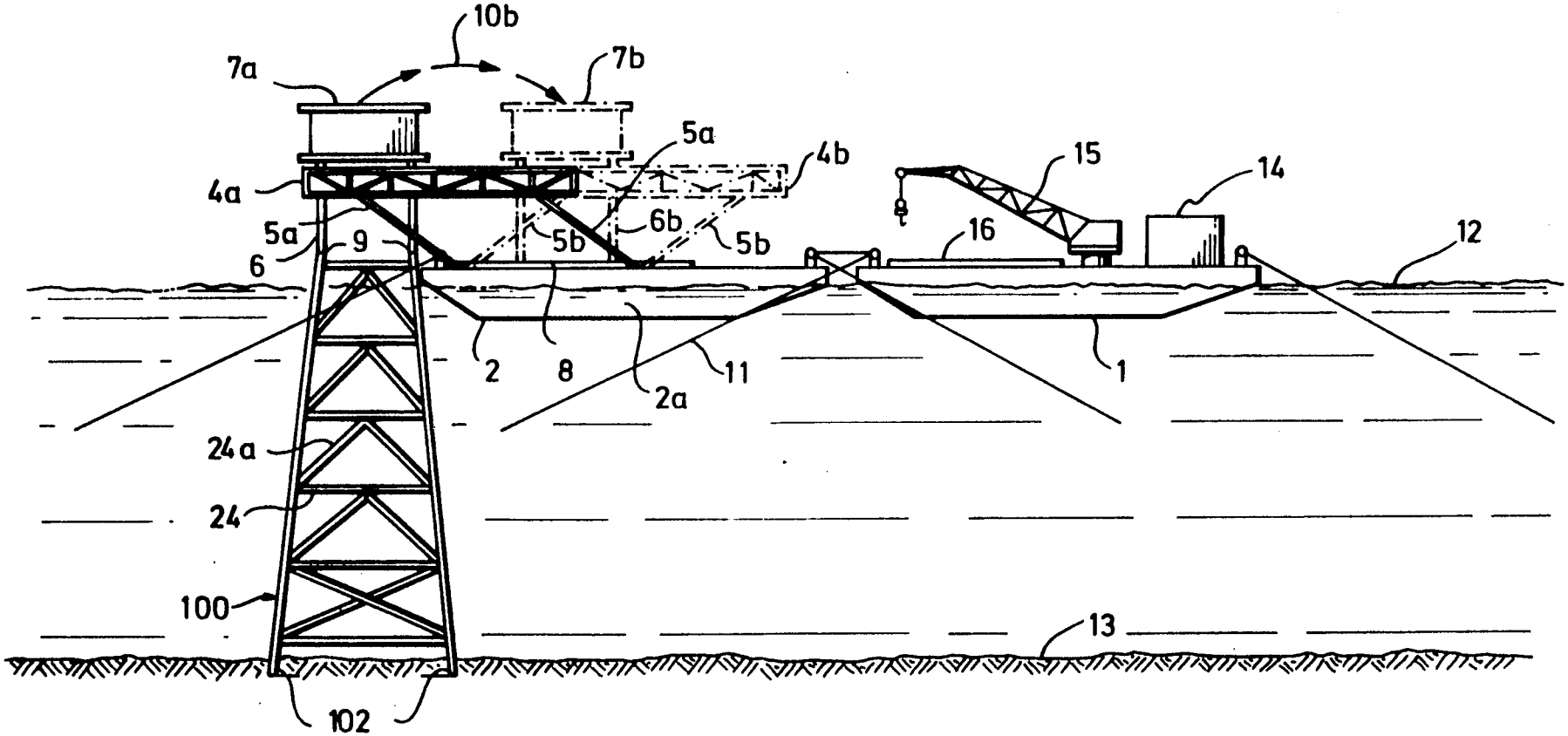
FIG. 2 depicts the control unit and a deck-lifting offshore unit adjacent to an offshore structure, attaching to the structure and removing the deck portion of the structure.

The system of the invention contains three major elements: a control unit, a deck lifting barge or unit, and a semi-submersible barge or a jacket lifting structure. The removal of the entire offshore structure is carried out in two major steps: the removal of the deck, and the removal of the jacket. FIGS. 1 and 2 depict the use of the control unit 1 and the deck-lifting barge 2 to remove a deck, which is stationed above the ocean surface or waterline. Whereas, FIGS. 3–7 depict the use of a control unit 1 and a jacket lifting unit 110 to remove the jacket 100 that is resting on or is embedded in the ocean floor.

As noted earlier, FIG. 1 depicts the apparatus used for removing a platform or deck 7*a*. This apparatus contains two major items: A control unit 1 and a deck lifting barge 2. The control contains, among other things, a strong back 16, a mooring system 11, utility crane(s) 15, and a control room 14. The control room generally includes crew quarters as well. The control unit 1 is usually self propelled and is equipped with all of the necessary equipment such as compressors, pumps, anchors piping, etc. The control unit 1 also contains mooring systems, thrusters and anchors (not shown). When the system is in operation, the control unit 1, mooring systems and anchors provide stability to the deck lifting barge 2.

The deck lifting unit 2 shown in FIG. 1 contains, among other things, a barge 2*a* that has a strong back 8, a truss 4*a* and a plurality of spaced apart lifting beams 5*a*. The strong back 8 is usually mounted in the fore and aft direction on the top surface of the barge 2*a*. The lower end of each lifting beam 5*a* is hingedly connected to the strong back 8 at positions 105. The upper end of each lifting beam is hingedly connected to the truss 4*a* at locations 107. This construction provides both lateral and vertical movement for the truss member 4*a*, while maintaining its top surface in a horizontal position throughout its movement. Two positions of the truss are shown by 4*a* and 4*b* respectively. The corresponding positions of the lifting beams are shown by 5*a* and 5*b* respectively. Truss 4*a* and lifting beams 5*a* are capable of lifting and supporting the platform 7*a*. Lifting means utilizing hydraulic or mechanical means are provided on the barge 2*a* to lift and laterally move the truss 4*a* and the lifting beams about hinged positions 105 and 107. The movement of the truss member about positions 105 and 107 is shown by 10*a*. This structure enables the truss 4*a* to extend beyond the aft end of the barge 2*a* of the deck-lifting unit , which provides a clear workable space below a substantial portion of the truss. One such position of the truss, although not one of the extreme positions, is shown by solid lines 4*a* and 5*a*. This construction allows substantial flexibility of operation during erection and removal of offshore structures. Another position of truss 4*a*, near the top surface of the barge, is shown by dotted lines in FIG. 1. The lifting means described above is capable of positioning the truss anywhere between the two extreme positions. Also, the truss and lifting beam structure is capable of supporting the entire platform at any given position. This structure, thus, provides great flexibility of operation along both the lateral and the vertical direction.

During the transportation of the deck-lifting barge 2, the truss is generally made to rest in the extreme position, which is somewhat lower than the position shown by 4*b*. When the deck lifting barge is being towed toward the offshore structure to be removed, the truss 4*a* is moved from its transport position to the position shown by solid lines. In this position, the upper surface of the truss 4*a* is below the bottom of the deck 7*a*.

Now referring to FIG. 2, to remove the platform 7*a*, the control unit 1 and the deck lifting barge 2 are moved or brought near the platform. The barge 2*a* is partially flooded or ballasted with water to lower the deck lifting unit 2 and, thus, truss 4*a* to a level that is below the bottom surface of the platform 7*a*. Truss 4*a* is then positioned underneath the platform as shown by the solid lines 5*a*. The barge 2 is then deballasted to raise the truss until it exerts strain on the platform 4*a*. The platform legs are then severed from the jacket at the splice point 9 to detach it from the jacket structure 100. At this point, the platform is fully supported by the truss 4*a*, and the entire load of the platform is being transferred to the strong back 8 via lifting beams 5*a*. The truss 4*a* and the lifting beams 5*a* are then slowly moved by the lifting means until the weight of the deck is transferred directly to the barge 2*a* via legs 6 as shown by dotted-lines 6*b* and 7*b*. The movement of the platform from its resting position on the jacket to the deck-lifting unit is indicated by the line 10*b*. The deck-lifting unit is then cut loose from the control unit, ballasted (if necessary) to obtain trim for towing, towed onshore, unloaded and then moved to the next offshore construction site. When the removed platform needs to be moved a great distance that may take several days, it is more economical to tow the deck lifting unit using smaller tug boats while utilizing the more expensive control unit to perform other operations such as removing the jacket structure 100. This method, thus provides an economical and efficient use of the equipment while being extremely flexible.

Figure 3:
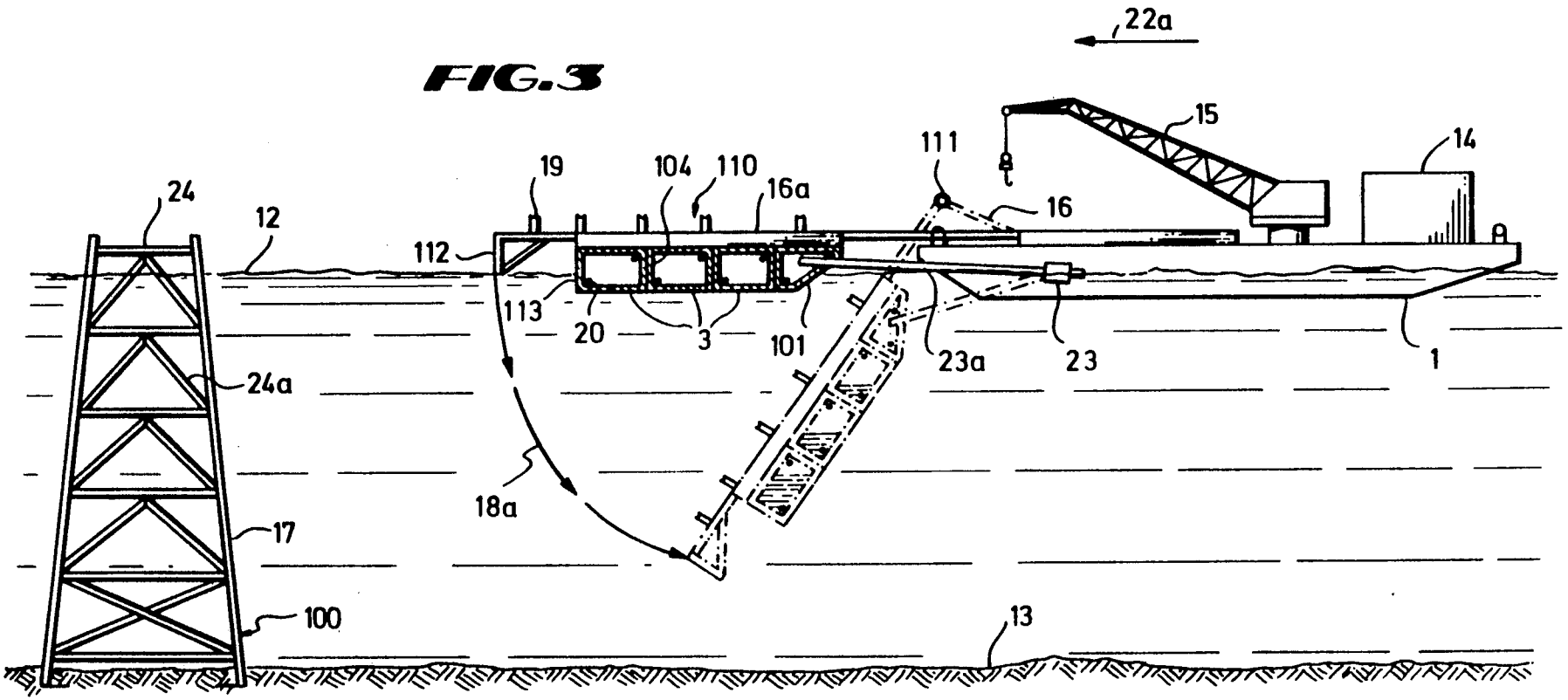
FIG. 3 depicts a semi-submersible barge being moved and lowered in, a body of water near a jacket.

FIGS. 3–6 illustrate the apparatus and method for removing the bottom portion of an offshore structure, like jacket 100. The lower end of the jacket 100 either rests on or is below the ocean floor. FIG. 3 depicts a semi-submersible barge or jacket-lifting unit 110 moored to the control unit 1 and being positioned to remove the jacket 100. The jacket lifting unit contains a strong back 16*a* with its upper end pivotly connected to one end of the strong back 16 of the control unit 1 at point 111. The other end of the strong back 16*a* terminates into a base structure 112, which is capable of supporting the jacket 100 and the entire jacket lifting unit 110. A number of spaced apart grappling members 19 are adjustedly attached to one side of the strong back 16*a*. These grappling members are designed to securely hold (grapple) the cross bars 24 of the jacket 100. At least one semi-submersible vessel 113 having ballastable sections is securely attached to the strong back member on the opposite side to which the grappling members 19 are attached. The base 112 serves as a safety shield for the ballast tank structure. The structure described here enables the semi-submersible barge 110 to float with the grappling members exposed to the atmosphere, as illustrated by the solid lines in FIG. 3.

Still referring to FIG. 3, the ballast tank structure 113 contains a number of ballast tanks 3 in series. The ballast tank structure 113 is constructed by installing airtight bulkheads 104 at predetermined locations inside a barge to create separate ballast tanks 3. For use in deep water and/or for removing heavy structures, multiple barges may be connected to the strong back 16*a* in series or in parallel to provide the required number of ballast tanks. At present, utilizing commonly available barges to construct the ballast tank structure is economical because of the abundance of available barges. Such a construction can be used to remove a majority of currently installed jackets offshore. Referring back to FIG. 3, the upper most end of the semi-submersible barge 101 is pivotly connected to a stabilizer 23 on the control unit 1 with a long rod 23*a*. The stabilizer itself pivots on the control unit, and is usually a hydraulic cylinder through which the rod 23*a* extends. The water depth, the length and weight of the jacket structure 100 are some of the factors that determine the length of the strong back 16*a* and the number of connected ballast tanks that are required to remove or install a particular structure.

As noted earlier, the system of the invention is not limited to a particular water depth or the jacket structure weight. For deeper water applications, longer semi-submersible barges may be employed. For such operations, the stabilizer bar provides a much needed lateral stability to the jacket-lifting unit (not shown). Furthermore, thrusters may also be used on the semi-submersible barge and/or the control unit to provide additional stability. For removal of heavier offshore structures, the number of ballast tanks can be readily increased. Serially linking ballast tanks enables one to control the flooding of the ballast tank structure over its entire length, thereby providing greater control over the ascent and descent angle of the semi-submersible barge. The system of the invention, thus, provides greater stability over a wide range of operating conditions, which can be a critical factor in deep and/or rough sea operations.

Still referring to FIG. 3, each ballast tank contains a water inlet and outlet port 20, and an air inlet and outlet port 21 to independently control the flooding and deballasting of the ballast tanks. Each ballast tank also contains a pair of pressure sensors (47*a* and 47*b*, shown in FIG. 8), one inside the tank to monitor the internal tank pressure, and one outside the tank to determine the pressure on that tank. The inside and outside pressures of each ballast tank are continually monitored to obtain the pressure differential on each tank section, which is used to control the ballasting and deballasting of the ballast tanks 3 for stable operation, which is especially important in deep and/or rough sea operations, like in the north sea.

Still referring to FIG. 3, once the semi-submersible barge has been moved close to the operation site, i.e., the jacket 100, the ballast tanks are independently flooded at varying rates to control the descent angle of the semi-submersible barge. One such descent movement is indicated by the line 18*a*. In certain applications, it may be desirable to flood the ballast tanks at the same rate. One possible position of the semi-submersible barge, while the ballast tanks are being flooded, is shown by the dotted-lines. As an example, FIG. 3 illustrates that the lower most ballast tank has been substantially flooded, while the top most ballast tank is completely empty. For a given application, utilizing a sufficient number of ballast tanks 3, their controlled flooding, and the use of the stabilizer 23 provide a safe and stable removal of large structures that, in some cases, are several hundred feet long and weigh several thousand tons. For the removal of large structures, especially in deep or rough seas, it is highly desirable, and critical, to control the movement of the semi-submersible barge and the jacket throughout the operation.

Figure 4:
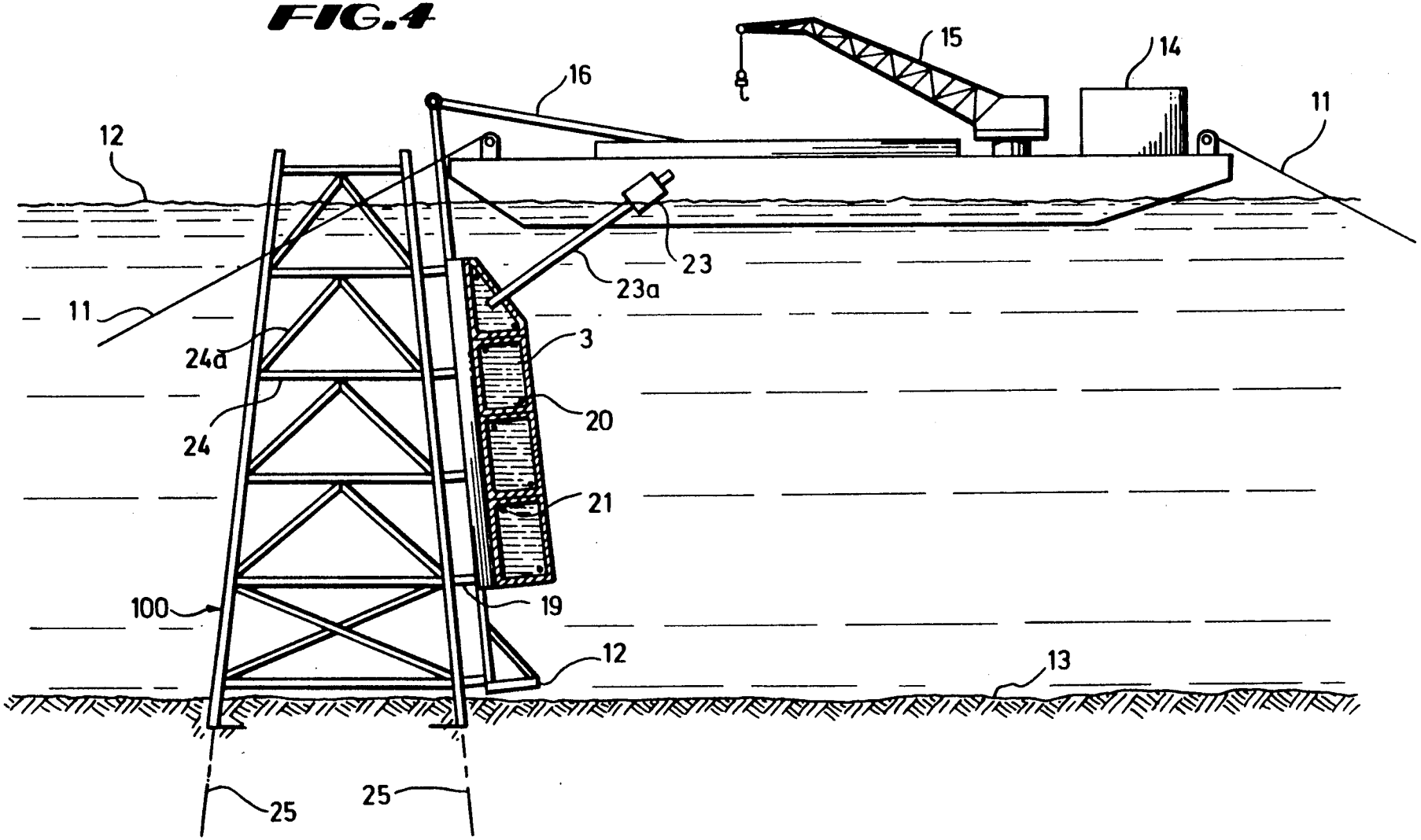
FIG. 4 depicts the semi-submersible barge with its grappling members attached to the jacket.

Now referring to FIG. 4, when the semi-submersible barge 110 has been fully lowered, it is brought adjacent to the jacket structure 100, the grappling members 19 are securely attached to cross members 24 of the jacket structure 100, while ensuring that the base 112 is resting on or is near the sea bed 13. It should be noted that FIG. 4 depicts fully flooded ballast tanks, i.e., there is no air present in any of the tanks. The full flooding of the tank aids in controlling the operation of the semi-submersible barge 110.

The system is now ready to start removing and lifting the jacket 100 from the sea bed. However, the steps taken to remove the jacket 100 depend upon the method in which the jacket 100 is placed on the sea bed 13. For jackets that rest on the sea bed (usually referred to as mud matt) or when the legs are not embedded too deep into the sea bed, the jacket can be removed from the sea bed by simply pulling the semi-submersible barge with the control unit by tilting the jacket structure about the base 112, and deballasting the tanks. The base 112 provides the necessary support to tilt the jacket in a stable manner.

Figure 5:
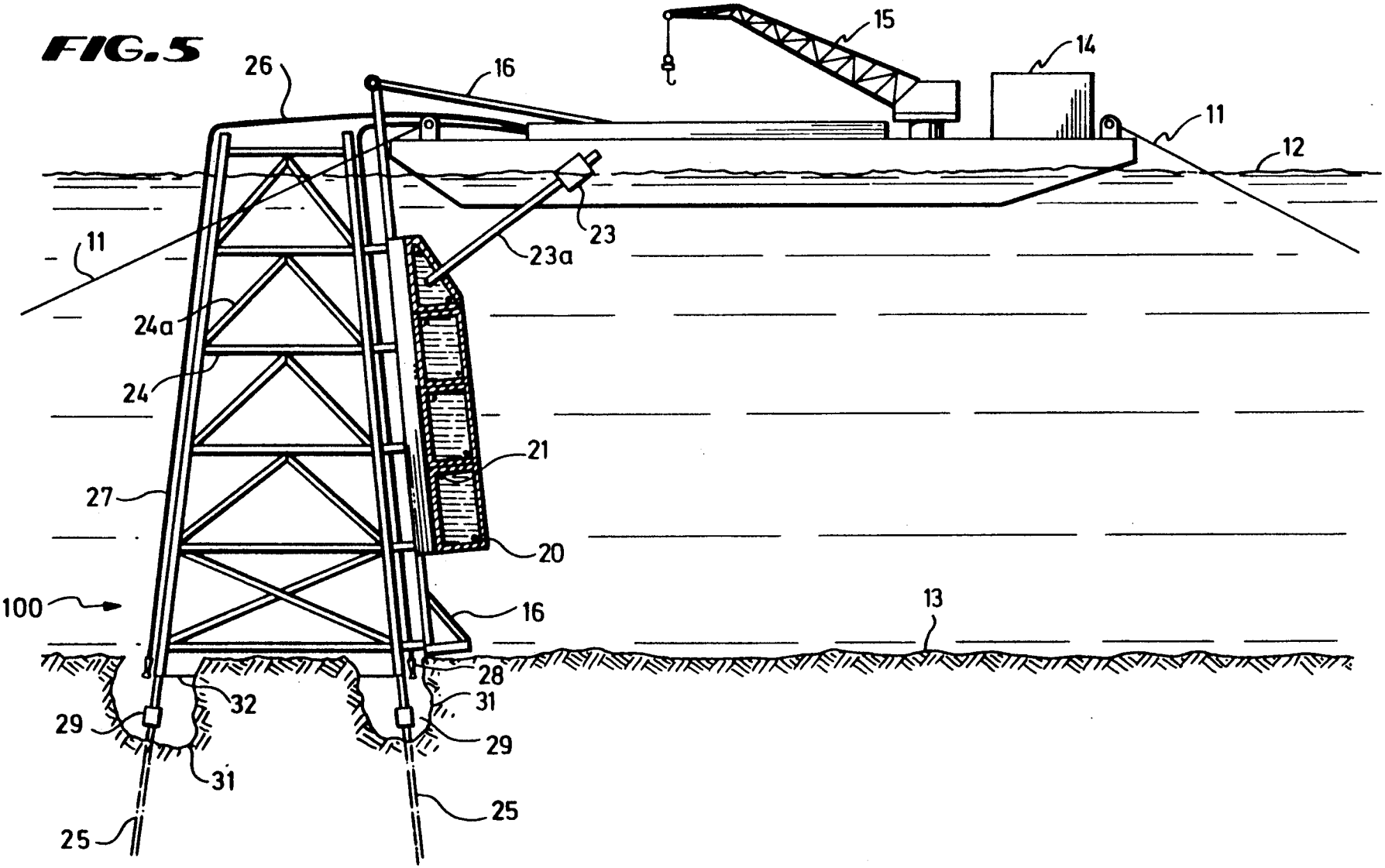
FIG. 5 depicts method of separating pilings from the jacket shown in FIG. 4.
Figure 6:
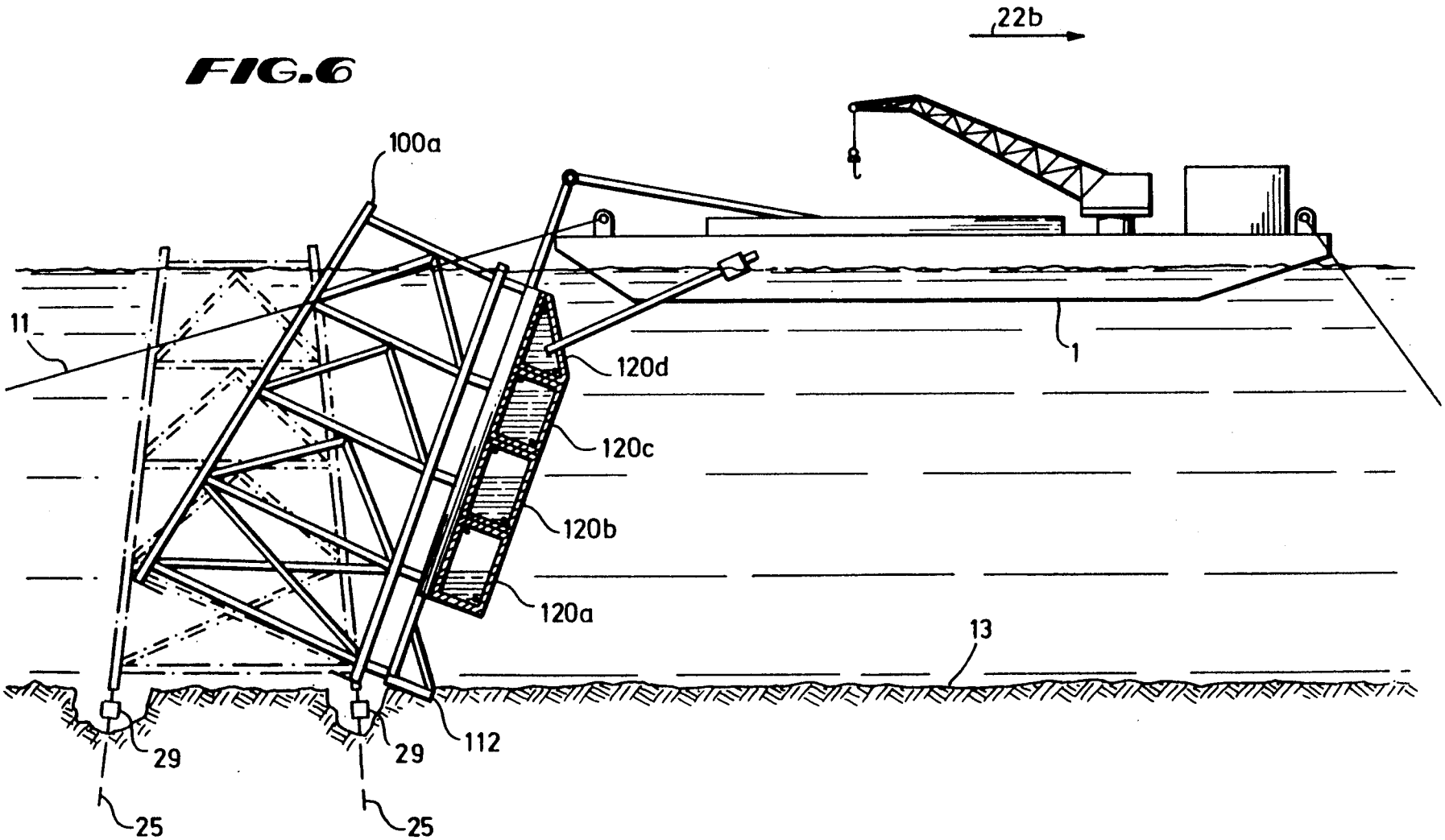
FIG. 6 depicts the removal and partial lifting of the jacket from the sea bed.
Figure 7:
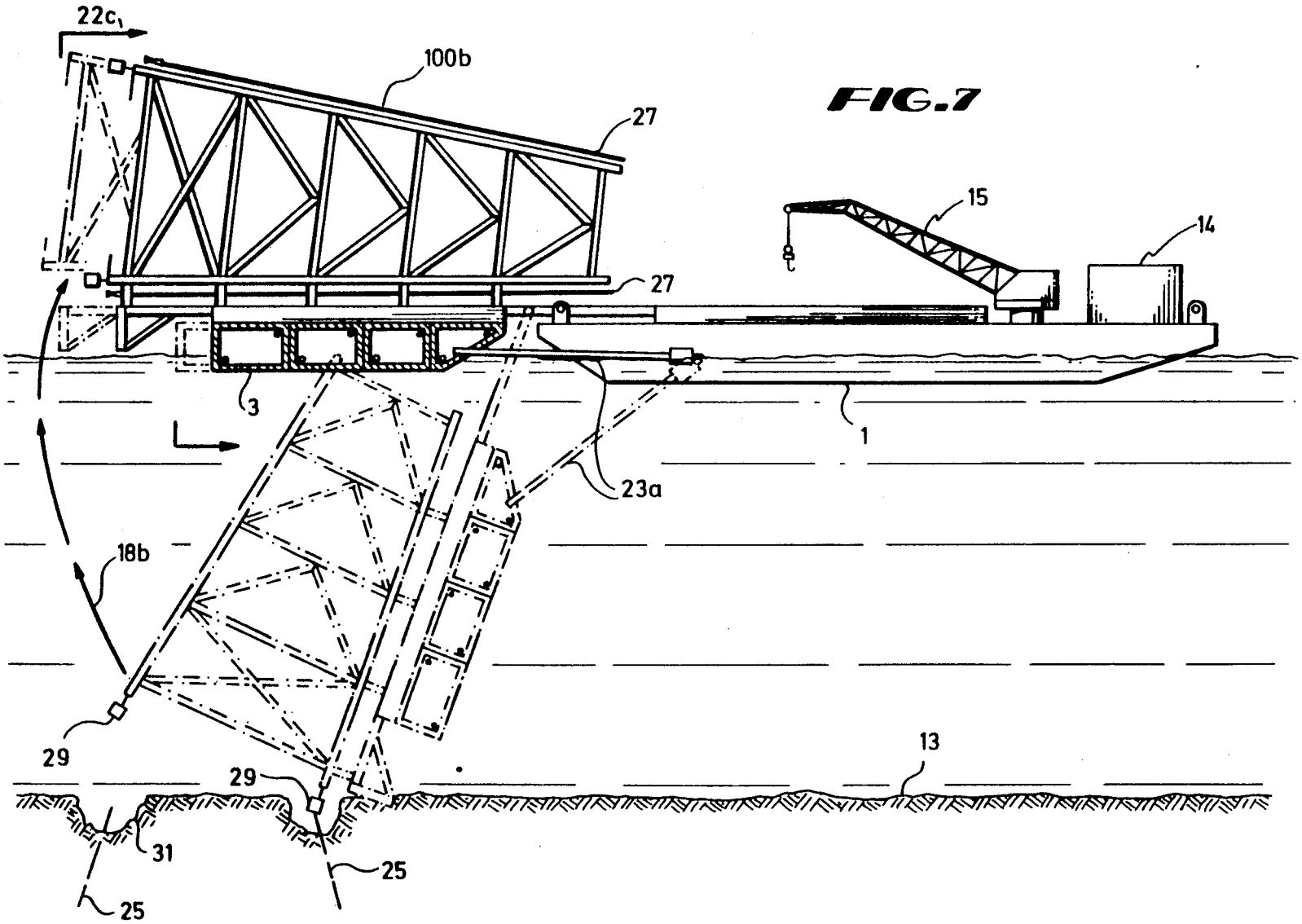
FIG. 7 depicts the lifting, flotation and towing away of the jacket.

Now referring to FIGS. 5 and 6, when the jacket legs are embedded deep under the sea bed, it is necessary to remove mud from around the jacket legs. This is usually accomplished by jetting away the mud from around each leg to create large cavities 31 in the sea bed. This loosens the jacket legs 17 sufficiently to enable them to be tilted when the control unit pulls the jacket lifting unit. However, in deep waters, piles 25 are usually driven through the jacket legs 17 to prevent the entire structure from toppling over. Often, these piles can be pulled straight up through jacket legs 17 with cranes after the platform has been removed. However, if a jacket leg(s) is bent or shifted due to storm, etc., the piles too get bent, and may need to be cut prior to tilting the jacket structure 100. In these situations, the pilings 25 are cut by torches 26, mechanical cutters 29 or other suitable method such as by blasting prior to removing the jacket. Once the pilings have been appropriately detached from the jacket legs, the semi-submersible barge 113 is tilted about the base 112 or the cutter 29 by moving the control unit away from the jacket structure 100. The ballast tanks 3 are independently deballasted at varying rates to slowly lift the entire structure including the elements used to cut the pilings. To lift heavy structures, it is desirable to deballast the lower ballast tanks at greater rates than the upper tanks. When the tanks have been emptied (filled with air), the jacket structure will float on top of the semi-submersible barge. The lifting movement of the jacket attached to the semi-submersible barge from the sea bed to the ocean surface is indicated by 18*b*. It should be noted that the use of multiple ballast tanks, their controlled deballasting and the stabilizer enable one to lift extremely large structures in deep and rough seas in a very safe and controlled manner. Further, once the structure is afloat, as shown in FIG. 7, the entire load of the jacket is taken by the submersible barge. Additionally, the entire operation, i.e., the removal of the platform 4a and the jacket structure 100, is accomplished without creating any vertical load on the control unit. Creating vertical loads on a barge shifts its actual center of gravity. The amount of shift depend upon the weight of the offshore structure being removed. Thus, the actual center of gravity of the barge cannot be determined and since barges are designed with a fixed actual center of gravity, any shift creates unsafe operation. In deep water operations or rough sea operations, creating vertical loads on a barge can be dangerous.

Figure 8:
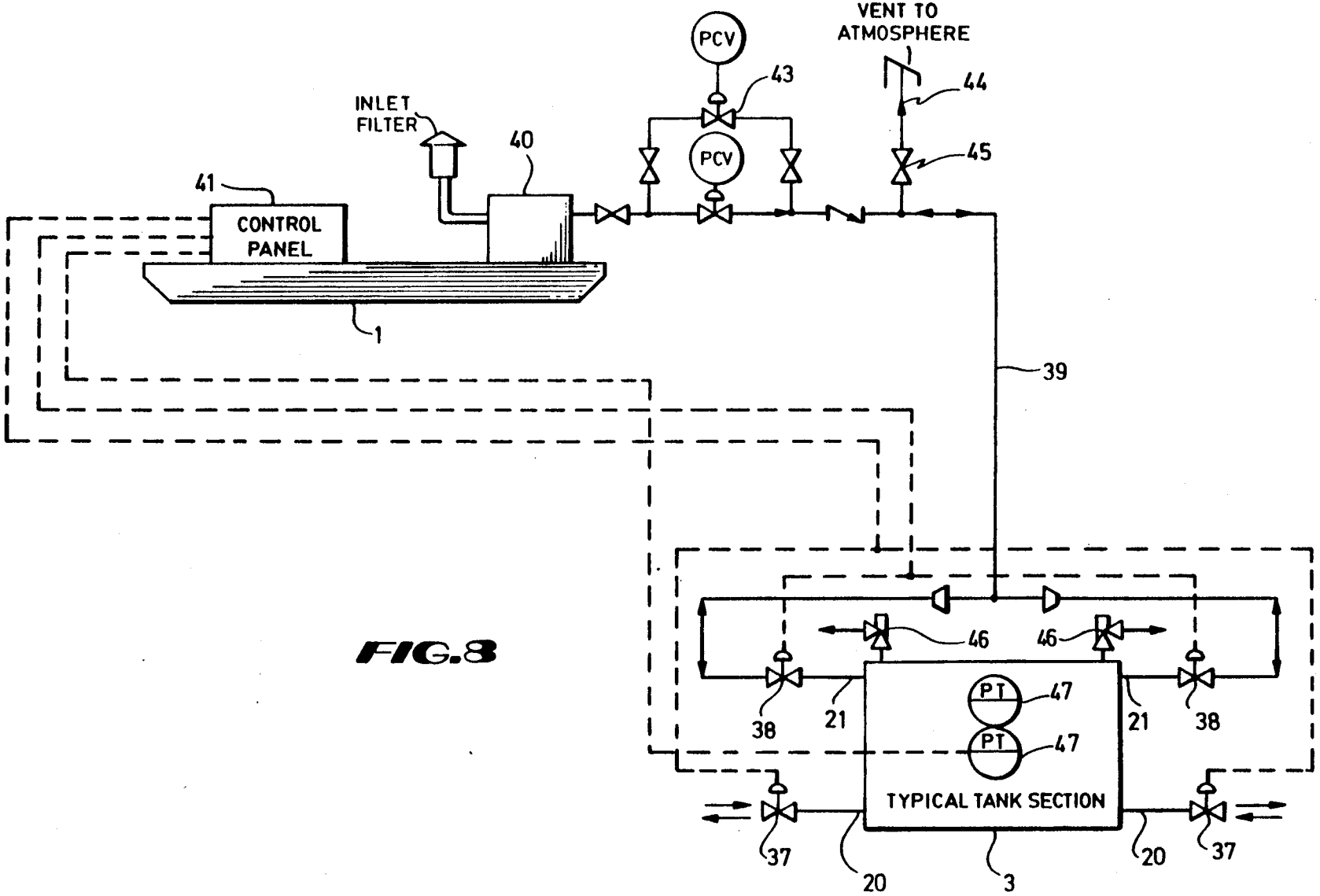
FIG. 8 is the flow diagram for a ballasting and deballasting system.

FIG. 8 depicts the flow diagram of ballasting and deballasting the ballast tanks. For simplicity, only one ballast tank is shown in FIG. 8. Water inlet and outlet valves 37 are attached to the water inlet and outlet ports 20 of the ballast tank 3. Air inlet and outlet control valves are attached to the air inlet and air outlet ports 21 of the ballast tank 3. A high velocity and high volume compressor 40 is connected to the air control valves with an air pipe 39. Pressure control valves control the rate of air input to the ballast tanks during deballasting. A vent pipe 44 is connected to piping 39 through a control valve 45 for use during submerging, i.e., ballasting of the ballast tanks. A control panel 41 controls the ballasting and deballasting operation of each ballast tank. A pair of pressure sensors are mounted on each tank to compute the pressure differential on each tank which is used to determine the flood rate and air input rate for each tank.

The system described hereinabove controls the ballasting an deballasting during operation. Each ballast tank can be flooded and deballasted at a different rate to provide a very controlled and stable ascent and descent of the semi-submersible barge.

The foregoing description has been directed to particular embodiments of the invention. It will be apparent, however, to those skilled in the art that many modifications and changes in the apparatus and method set forth will be possible without departing from the scope and spirit of the invention. It is intended that the following claims be interpreted to embrace all such modifications and changes.

What is claimed is:

1. An apparatus for erecting and removing a platform resting above the ocean surface on an offshore structure, said apparatus comprising a barge having a top surface, a strong back mounted on the top surface of the barge in the fore and aft direction, a plurality of spaced apart parallel lifting beams, one end of each said lifting beam being pivotly attached to the strong back and the other end of each said lifting beam being pivotly attached to a truss member so that when the lifting beams are moved, the truss member remains in a horizontal orientation above the top surface of the barge, and means for moving and positioning the lifting beams.

2. An apparatus for erecting and removing an offshore structure resting on the ocean floor, said apparatus comprising:

(a) a strong back having an upper and a lower end and a top and a bottom side;

(b) at least one grappling member attached to the top side of the strong back;

(c) a base connected to the bottom side of the lower end of the strong back, said base adapted to rest on the ocean floor and support the weight of eh apparatus;

(d) a ballast tank structure connected to the bottom side of the strong back between the base and the upper end of the strong back in a manner such that when the base is placed on the sea floor, the ballast tank structure remains above the sea floor, said ballast tank structure including a plurality of ballast tanks in series and sealed from each other; and (e) means for independently flooding and deballasting said ballast tanks at varying rates.

3. The apparatus as described in claim 2, wherein said ballast tank structure contains a barge, said barge containing a plurality of spaced apart airtight bulkheads to form said plurality of said ballast tanks.

4. A method of removing an offshore structure from the sea floor and floating it on a jacket-lifting unit, said jacket-lifting unit including a ballast tank structure which has in series a plurality of ballast tanks sealed from each other, said ballast tank structure attached to a strong back having a plurality of grappling members capable of removably attaching to the offshore structure, said strong back also having a base at the lower end for supporting the jacket lifting unit thereon, said method comprising the steps of:

(a) pivotally connecting the upper end of the strong back of the jacket-lifting unit to a control unit;

(b) placing the base on the sea floor near the offshore structure;

(c) securely attaching the grappling members of the jacket-lifting unit to the offshore structure;

(d) pulling the jacket-lifting unit away from the offshore structure site to tilt the jacket-lifting unit about the base; and (e) independently deballasting said ballast tanks at varying rates to raise the jacket-lifting unit and the offshore structure until the offshore structure is afloat on the jacket-lifting unit.

5. A method of removing an offshore structure resting on the sea floor and floating said offshore structure on a semi-submersible barge, said semi-submersible barge including at least two ballast tank structures connected to a strong back equipped with a plurality of grappling members, said strong back having a base at one end which is adapted to be placed on the sea floor and an end on the opposite side from the base pivotly connected to a control unit, each said ballast tank structure containing a plurality of serially connected ballast tanks, each said ballast tank being sealed from the other and adapted to be independently ballasted and deballasted, said method comprising the steps of:

(a) locating the semi-submersible barge near the offshore structure;

(b) independently and controllably flooding the ballast tanks at varying rates to lower the semi-submersible barge until said semi-submersible barge rests with its base at the sea floor in a near vertical position;

(c) securely attaching the grappling members to the offshore structure;

(d) tilting the semi-submersible barge about the base to loosen the offshore structure from the sea floor and to tilt it about the base;

(e) independently and controllably deballasting the ballast tanks at varying rates to slowly lift the semi-submersible barge and the offshore structure thereon until the offshore structure floats on the semi-submersible barge; and (f) towing the semi-submersible barge onshore.

6. Apparatus for erecting and removing a jacket structure resting on the ocean floor, said jacket structure containing structural members, said apparatus comprising:

(a) a strong back having a top and a bottom side and an upper and a lower end;

(b) a base connected to the lower end of the strong back, said base adapted to be placed on the ocean floor and capable of supporting the weight of the apparatus;

(c) a barge connected to the strong back in between the base and the upper end, said barge divided to form a plurality of ballast tanks in series, each said ballast tank being sealed from the other, each said ballast tank adapted to be flooded and deballasted independently and at a varying rate; and (d) a plurality of grappling members fixedly attached to the top side of the strong back, each said grappling member capable of attaching to the structural members of the jacket structure.

7. A method of removing a jacket structure from the sea, said jacket structure having one end embedded into the sea floor, said method comprising the steps of:

(a) locating a jacket-removal unit near the jacket structure, said jacket-removal unit comprising:

(i) a strong back having a front and a back side and a top and a bottom end, said bottom end having a base attached on the backside;

a barge attached to the back side of the strong back, said barge divided into a plurality of ballast tanks sealed from each other wherein each ballast tank is capable of being independently controlled for ballasting and deballasting operations; and (iii) a plurality of grappling members attached to the front side of the strong back;

(b) ballasting the individual ballast tanks at different rates so as to slowly and controllably submerge the jacket-removal unit into the sea until said jacket-removal unit is resting on the base at the sea floor and the grappling members are placed near the jacket structure;

(c) attaching the grappling members to the jacket structure;

(d) tilting the jacket-removal unit about the base and thereby tilting the jacket structure along therewith;

(e) pulling the jacket removal unit away from the jacket structure site until the embedded end is above the sea floor; and (f) deballasting the ballast tanks independent of each other and at different rates so as to slowly and controllably float the jacket structure on the jacket-removal unit.

8. A method of removing a jacket structure from the sea floor, said method comprising:

(a) locating a control unit and a jacket-removal unit near the jacket structure, said jacket structure comprising:

(i) a strong back with an upper and a lower end, and a front and a back side;

(ii) a base connected to the lower end of the strong back;

(iii) a barge having a top and a bottom end, said barge attached to the back side of the strong back between the upper and lower ends, said barge further having a plurality of ballast tanks, each said ballast tank sealed from the other and independently controllable for ballasting and deballasting operations;

(iv) a plurality of grappling members attached to the front side of the strong back; and (v) said control unit controlling the ballasting and deballasting of each said ballast tank, said control unit also pivotally connected to both the top end of the barge and the upper end of the strong back;

(b) independently and controllably ballasting each ballast tank at a desired rate so as to slowly and controllably lower the jacket-lifting unit into the sea until the base is resting on the sea floor;

(c) securely attaching the grappling members to the jacket structure;

(d) slowly pulling away the control unit away from the jacket structure site, thereby pulling away the jacket-removal unit and the jacket structure; and (e) independently deballasting each said ballast tank in said plurality of ballast tanks at a desired rate so as to slowly lift the jacket structure until it floats above the ocean surface on top of the jacket-removal unit.

9. A method of removing an offshore structure, said offshore structure including a deck and a jacket structure, said jacket structure having an upper and a lower end, the jacket structure erected in the sea with the lower end embedded in the sea floor and the upper end remaining above the water surface, said upper end attached to and supporting the deck, said method comprising the steps of:

(a) locating a control unit and a deck-lifting unit near the offshore structure, said control unit operatively connected to the deck-lifting unit and controlling the operation of the deck-lifting unit, the deck-lifting unit comprising:

(i) a top surface having a fore and an aft position;

(ii) a strong back, said strong back attached to the top surface of the deck-lifting unit in the fore and aft direction;

(iii) a plurality of spaced apart parallel beams, each said beam having a top and a bottom end, the bottom end of each said beam hingedly attached to the strong back; and (iv) a truss member having a lower and an upper surface, said lower surface of said truss member hingedly attached to the top end of each said beam so that the movement of the parallel beams in the fore and aft direction will cause the truss member to move in the fore and aft direction above the deck-lifting unit;

(b) locating the upper surface of the truss member underneath the deck;

(c) detaching the deck from the jacket structure to enable the deck to rest on the truss member;

(d) moving the parallel beams and thereby the truss member which is supporting the deck to place the deck on the top surface of the deck-lifting unit;

(e) moving the deck-lifting unit away from the jacket structure;

(f) detaching the control unit from the deck-lifting unit;

(g) connecting the control unit to a jacket-removal unit;

(h) locating the jacket-removal unit and the control unit near the jacket, said jacket-removal unit having:

(i) a strong back, said strong back having a front and back side and a top and a bottom end;

(ii) at least one ballast tank attached to the back side of the strong back; and (iii) a plurality of grappling members attached to the front side of the strong back, each said grappling member capable of removably attaching to the jacket structure;

(i) ballasting the ballast tanks to submerge the jacket-removal unit so as to locate the grappling members near the jacket structure;

(j) attaching the grappling members of the jacket-removal unit to the jacket structure;

(k) detaching the lower end of the jacket structure from the sea floor; and (l) deballasting the ballast tanks to float the jacket structure on top of the jacket-removal unit.

10. A method of removing an offshore structure having a deck and a jacket structure, the jacket structure having an upper and a lower end, the jacket structure placed in the ocean with the lower end resting on the ocean floor and the upper end above the sea surface, the deck attached to the upper end of the jacket structure, said method comprising the steps of:

(a) locating a deck-removal unit near the deck, said deck-removal unit having a truss member pivotly capable of supporting the load of the deck, said truss member attached on top of the deck-removal unit by a plurality of parallel lifting beams so that when the lifting beams are moved, the truss member moves above deck while always remaining in a horizontal orientation;

(b) locating the truss member underneath the deck;

(c) detaching the deck from the jacket structure so as to place the deck on the truss member;

(d) moving the truss member and thereby the deck until the truss member is placed on the deck-removal unit;

(e) placing a jacket-removal unit near the jacket-structure, the jacket-removal unit containing a strong back having a front and a back side, at least one ballast tank attached to the back side of the strong back and a plurality of grappling members attached to the front side of the strong back, each of said grappling members capable of attaching to the jacket structure;

(f) ballasting the ballast tanks at varying rates to place the jacket-removal unit near the jacket;

(g) attaching the grappling member to the jacket structure; and (h) deballasting the ballast tank to afloat the jacket-removal unit.

11. An apparatus for erecting and removing offshore platforms resting above the ocean surface on an offshore structure, said apparatus comprising:

(a) a first barge, said first barge having:

(i) a deck;

(ii) a strong back mounted on the deck of the barge in the fore and aft direction;

(iii) a plurality of spaced apart parallel lifting beams each lifting beam having a first and a second end, the first end of each said lifting beam pivotly connected to said strong back in a manner so that the second end of each said lifting beam can move about the first end in the fore and aft direction; and (iv) a truss member, said truss member having a top and a bottom side, said bottom side of the truss member pivotly connected to the second end of each said lifting beam so that when said lifting beams are moved in the fore and aft direction, the truss member moves above the deck in the fore and aft direction about the first end of each of the lifting beams; and (b) a second barge, said second barge operatively connected to said first barge, said second barge containing means for moving the lifting beams and thereby the truss in the fore and aft direction.

* * * * *